US009863099B2

(12) United States Patent
Cornelus et al.

(10) Patent No.: US 9,863,099 B2
(45) Date of Patent: Jan. 9, 2018

(54) STRUCTURE FOR THE REINFORCEMENT OF PAVEMENTS COMPRISING ASSEMBLIES OF GROUPED METAL FILAMENTS COUPLED TO OR INTEGRATED IN A SUBSTRATE

(71) Applicant: NV BEKAERT SA, Zwevegem (BE)

(72) Inventors: Henk Cornelus, Avelgem (BE); Ann Lambrechts, Avelgem (BE); Frederik Vervaecke, Ghent (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 14/771,980

(22) PCT Filed: Apr. 3, 2014

(86) PCT No.: PCT/EP2014/056682
§ 371 (c)(1),
(2) Date: Sep. 1, 2015

(87) PCT Pub. No.: WO2014/161930
PCT Pub. Date: Oct. 9, 2014

(65) Prior Publication Data

US 2016/0010290 A1 Jan. 14, 2016

(30) Foreign Application Priority Data

Apr. 4, 2013 (EP) ..... 13162262

(51) Int. Cl.
*E01C 11/00* (2006.01)
*E01C 11/16* (2006.01)
(Continued)

(52) U.S. Cl.
CPC ..... *E01C 11/16* (2013.01); *D03D 15/02* (2013.01); *D04B 21/14* (2013.01); *E01C 5/22* (2013.01);
(Continued)

(58) Field of Classification Search
CPC ..... E01C 5/22; E01C 11/16; E01C 11/165; E01C 11/005; E01C 23/04; E01C 29/0225
(Continued)

(56) References Cited

U.S. PATENT DOCUMENTS 3,331,178 A * 7/1967 Allers ..... B28B 23/04 140/149
5,513,925 A * 5/1996 Dempsey ..... B32B 7/02 404/17
(Continued)

FOREIGN PATENT DOCUMENTS

DE 201 19 933 U1 5/2002
EP 0134604 A1 3/1985
(Continued)

OTHER PUBLICATIONS

International Search Report for PCT/EP2014/056682 dated Jul. 28, 2014.

*Primary Examiner* — Raymond W Addie
(74) *Attorney, Agent, or Firm* — Bacon & Thomas, PLLC

(57) ABSTRACT

A structure for the reinforcement of pavements. The structure includes at least a first group of assemblies of grouped metal filaments. These assemblies of grouped metal filaments of said first group are oriented in a first direction in a mutual parallel or mutual substantially parallel position. The assemblies of grouped metal filaments of this first group are coupled to or integrated in a substrate having a non-metal material.

19 Claims, 3 Drawing Sheets

(51) Int. Cl.

| | |
|---|---|
| ***E02D 29/02*** | (2006.01) |
| ***E01C 5/22*** | (2006.01) |
| ***E01C 23/04*** | (2006.01) |
| ***D04B 21/14*** | (2006.01) |
| ***D03D 15/02*** | (2006.01) |

(52) U.S. Cl.
CPC ..... *E01C 11/005* (2013.01); *E01C 11/165* (2013.01); *E01C 23/04* (2013.01); *E02D 29/0225* (2013.01); *D10B 2101/20* (2013.01); *D10B 2505/02* (2013.01); *D10B 2505/204* (2013.01)

(58) Field of Classification Search
USPC ..... 404/17, 18, 21, 27, 31, 72, 75
See application file for complete search history.

(56) References Cited

U.S. PATENT DOCUMENTS 5,525,416 A * 6/1996 Katz ..... B32B 27/12 156/278
5,941,656 A * 8/1999 Sugiyama ..... E01C 11/005 14/73
6,458,920 B1 * 10/2002 Baxendell ..... C08G 64/406 528/196
7,160,049 B2 * 1/2007 Saito ..... E01C 7/00 404/17
7,232,276 B2 * 6/2007 Oka ..... E01C 3/06 404/31
7,897,254 B2 * 3/2011 Kadrmas ..... C08L 95/00 404/17
8,038,364 B2 * 10/2011 Newton ..... C09D 133/08 404/17
8,043,025 B2 * 10/2011 Hernandez-Torres E01C 11/005 404/17
2004/0120765 A1 * 6/2004 Jones, IV ..... E01C 7/187 404/35
2008/0184667 A1 * 8/2008 Hindi ..... E04C 5/0618 52/831
2010/0326326 A1 * 12/2010 Rigaud ..... C04B 28/04 106/709

FOREIGN PATENT DOCUMENTS

| | | | |
|---|---|---|---|
| EP | 0429106 | A1 | 5/1991 |
| EP | 1726742 | A2 | 11/2006 |
| FR | 2572426 | A1 | 5/1986 |
| WO | 95/11351 | A1 | 4/1995 |
| WO | 2009/062764 | A1 | 5/2009 |
| WO | 2013/036848 | A1 | 3/2013 |

* cited by examiner

STRUCTURE FOR THE REINFORCEMENT OF PAVEMENTS COMPRISING ASSEMBLIES OF GROUPED METAL FILAMENTS COUPLED TO OR INTEGRATED IN A SUBSTRATE

The invention relates to a structure for the reinforcement of pavements. The invention also relates to a reinforced pavement.

Furthermore the invention relates to a method of retarding reflective cracking from a distressed and cracked pavement structure.

BACKGROUND ART

Repairing roads by applying an overlay, such as an asphalt overlay, to the road surface is well known in the art. A serious drawback of this method includes reflective cracking. Reflective cracking is the process by which an existing crack, discontinuity or joint propagates towards the surface through an overlying layer of asphalt.

Once a reflective crack reaches the surface, an open path is created allowing the penetration of water into the lower layers of the pavement. Left untreated, this situation will lead to further deterioration of the pavement structure and to a reduction in overall serviceability.

The use of interlayers, such as steel wire meshes, geogrids, non-woven structure and stress relieve membranes also called stress absorbing interlayers or SAMI has gained widespread acceptance. Products of varying types have been used to either reinforce the asphalt or to provide a relatively impermeable layer within it, thereby improving the long-term performance of the pavement.

Although it has been proven that steel meshes such as hexagonal woven meshes, are successful to reduce cracking in the overlay, steel meshes have the drawback that the installation is difficult due to the rigid nature of such steel meshes.

A further drawback of the use of steel meshes is that thick overlay layers of for example 8 cm or more are required in order to be efficient.

Geogrids are commonly made of a polymer material (for example polyester, polyethylene or polypropylene), made of glass (for example glass rovings) or made of carbon (for example carbon filaments). Polymer material and glass material have a limited strength. Furthermore, polymer material can lose its integrity due to the high temperature of the asphalt during installation (160° C.). Glass can get damaged during its installation due to its brittle nature and requires additional protection.

SUMMARY OF THE OF INVENTION

It is an object of the present invention to provide a structure for the reinforcement of pavements avoiding the drawbacks of the prior art.

It is another object of the present invention to provide a structure for the reinforcement of pavements that is easy to install.

It is a further object of the present invention to provide a structure for the reinforcement of pavements comprising assemblies of grouped metal filaments that can easily be rolled up and rolled out and that when rolled out lies in a flat position and remains in this flat position making additional precautions or steps to obtain a flat position of the structure superfluous. Furthermore it is an object of the present invention to provide a structure for the reinforcement of pavements comprising assemblies of grouped metal filaments whereby the assemblies are hold in a mutual parallel position or mutual substantially parallel position and whereby the assemblies are secured in this mutual parallel position or substantially parallel position for example during manufacturing, transporting, installation and use of the structure.

It is a further object of the present invention to provide a structure for the reinforcement of pavements prolonging the service life of pavements.

It is still a further object of the present invention to provide a method of retarding reflective cracking in distressed and cracked pavement structures.

According to a first aspect of the present invention a structure for the reinforcement of pavements is provided. The structure comprises a first group of assemblies of grouped metal filaments. The assemblies of grouped metal filaments of the first group are oriented in a mutual parallel or a mutual substantially parallel position in a first direction. The assemblies of grouped metal elements of the first group are coupled to or integrated in a substrate comprising a non-metal material.

Non-metal material comprises for example glass, carbon or polymer material. Preferred polymer materials comprise polyester, polyamide, polypropylene, polyethylene, polyvinyl alcohol, polyurethane, polyethersulphone, or any combination thereof.

Preferred embodiments comprise structures having assemblies of grouped metal filaments that are coupled to a substrate comprising a non-metal material, for example a substrate consisting of a non-metal material. Other preferred embodiments comprise structures having assemblies of grouped metal filaments that are integrated in a substrate comprising a non-metal material, for example a substrate consisting of a non-metal material.

The structure has a length L and a width W, with L being larger than W. The structure has a longitudinal direction and a transverse direction, the transverse direction being perpendicular to the longitudinal direction.

With "mutual parallel position" or "mutual substantially parallel position" is meant that the main axes of the assemblies of grouped metal filaments of the first group are parallel or substantially parallel to each other.

With "substantially parallel" is meant that there may be some deviation from the parallel position. However, if there is a deviation, the deviation from the parallel position is either small or accidental. With a small deviation is meant a deviation less than 5 degrees and preferably less than 3 degrees or even less than 1.5 degrees.

By coupling the assemblies of grouped metal filaments of the first group to a substrate or by integrating the assemblies of grouped metal filaments in a substrate, the assemblies are kept in their mutual parallel or mutual substantially parallel position and this during manufacturing, transporting, installation of the structure for the reinforcement of pavements and during use of the structure once the structure is installed.

The term 'coupled to' should be understood in a broad meaning and includes all possible manners whereby the assemblies of grouped filaments are coupled to a substrate. For the purpose of this invention coupling includes connecting, joining, bonding, gluing, adhering, laminating . . . .

The assemblies of grouped filaments can be coupled, joined, bonded, glued, adhered, laminated to the substrate by any technique known in the art. Preferred techniques comprise stitching, knitting, embroidering, gluing, welding and melting.

As substrate any substrate comprising a non-metal material allowing the coupling of the assemblies of grouped filaments to can be considered. Suitable substrates comprise woven structures, non-woven structures, films, strips, foils, meshes, grids or foams comprising a non-metal material or consisting of a non-metal material.

As non-woven substrates needlebonded, waterbonded, spunbonded, airlaid, wetlaid or extruded substrates can be considered.

Preferred foils or grids are foils or grids obtained by extrusion, for example foils or grids comprising polypropylene, polyethylene, polyamide, polyester or polyurethane.

The substrate may comprise an open structure or alternatively a closed structure. A substrate having an open structure has the advantage that it is permeable and ensures better anchorage.

In preferred embodiments the assemblies of grouped metal filaments are coupled to a substrate by gluing the assemblies of grouped metal filaments to this substrate, for example to a grid of a non-metal material such as a polymer material. By gluing the assemblies of grouped metal filaments to a substrate, the assemblies of grouped metal filament are held and secured in their mutual parallel or substantially parallel position and are ensured it this position during the manufacturing, storing, transporting, installation and use of the structure as reinforcement of a pavement.

In other preferred embodiments the assemblies of grouped metal filaments are coupled to the substrate by at least one yarn. The at least one yarn holds the assemblies of grouped metal filament in their mutual parallel or substantially parallel position and ensures that the assemblies of grouped metal filaments are secured in their mutual parallel or mutual substantially parallel position and this during the manufacturing, storing, transporting, installation and use of the structure as reinforcement of a pavement.

Yarn

The yarn comprises preferably a textile yarn.

For the purpose of this invention with "yarn" is meant any fiber, filament, multifilament of long length suitable for use in the production of textiles. Yarns comprise for example spun yarns, zero-twist yarns, single filaments (monofilaments) with or without a twist, multifilament yarns, narrow strip of materials with or without twist, intended for use in a textile structures.

The at least one yarn may comprise a natural material, a synthetic material or a metal or metal alloy.

Natural material comprises for example cotton.

Preferred synthetic materials comprise polyamide, polyether sulphone, polyvinyl alcohol and polypropylene. Also yarns made of glass fibers or rovings can be considered.

Preferred metal or metal alloys comprise steel such as low carbon steel, high carbon steel or stainless steel.

Preferably, the yarn used in the structure for the reinforcement of a pavement should be suitable for use in a textile operation such as sewing, stitching, knitting, embroidery and weaving.

In order to be suitable in a textile operation and more particularly in a sewing, knitting or embroidery operation, the yarn is preferably bendable. Preferably, the at least one yarn can be bent to a radius of curvature smaller than 5 times the equivalent diameter of the yarn. More preferably the at least one yarn can be bent to a radius of curvature lower than 4 times the diameter of the yarn, lower than 2 times the diameter of the yarn or even lower than the diameter of the yarn.

Furthermore the yarn used should be suitable to hold and secure the assemblies of grouped metal filaments in their mutual parallel or mutual substantially parallel position.

It is clear that the yarn used should allow to maintain the flexibility of the structure so that the structure can be rolled up and rolled out easily.

Preferably, the yarn used in the structure for the reinforcement of a pavement is suitable for use in textile operation such as sewing, stitching, knitting, embroidery and weaving.

Furthermore the yarn is preferably suitable to hold and secure the assemblies of grouped metal filaments in their mutual parallel or mutual substantially parallel position.

It is clear that the yarn preferably allows to maintain the flexibility of the structure so that the structure can be rolled up and rolled out easily.

The structure for the reinforcement of pavements according to the present invention may comprise one yarn or a number of yarns. The number of yarns is for example ranging between 1 and 100; for example ranging between 1 and 50, for example 10.

The at least one yarn preferably forms stitches to connect the assemblies of grouped metal filaments to the substrate. The stitches are preferably formed around the assemblies of grouped metal filaments.

The stitches are preferably formed by at least one operation selected from stitching, knitting or embroidering.

Also the term 'integrated in' should be understood in a broad meaning and includes all possible manners whereby the assemblies of grouped filaments are integrated in a substrate. For the purpose of this invention integrating the assemblies in a substrate includes embedding the assemblies in a matrix material such as a polymer matrix material. The assemblies are for example embedded in a polymer strip.

Integrating the assemblies in a substrate also includes the integration of the assemblies during the manufacturing of the substrate, for example the integration of the assemblies in a woven structure during the manufacturing of the woven structure or of a knitted structure. The assemblies are for example integrated in the warp direction of a woven structure whereas the weft direction comprises non-metal material. In another example the assemblies are integrated in in the longitudinal direction of a knitted structure.

Similarly, the assemblies can be integrated in a non-woven structure during the manufacturing of the non-woven structure.

Assembly of Grouped Filaments

For the purpose of this invention with "an assembly of grouped metal filaments" is meant any unit or group of a number of metal filaments that are assembled or grouped in some way to form said unit or said group. The metal filaments of an assembly of grouped metal filaments can be assembled or grouped by any technique known in the art, for example by twisting, cabling, bunching, gluing, welding, wrapping, . . . .

Examples of assemblies of grouped metal filaments comprise bundles of parallel or substantially parallel metal filaments, metal filaments that are twisted together for example by cabling or bunching such as strands, cords or ropes.

A first group of preferred assemblies of grouped metal filaments comprise cords, for example single strand cords or multistrand cords.

Structures for the reinforcement of pavement comprising cords as assemblies of grouped metal filaments have the advantage that they can easily be rolled up and rolled out. Furthermore structures for the reinforcement of pavement comprising cords lie in a flat position when rolled out and remain in this flat position without requiring additional precautions or steps to obtain or maintain this flat position.

A second group of preferred assemblies of grouped filaments comprise bundles of parallel filaments. Structures for the reinforcement of pavement comprising bundles of parallel filaments as assemblies have the advantage that they can easily rolled up and rolled out and that such structures lie in a flat position when rolled out and remain in this flat position without requiring additional precautions or steps to obtain or maintain this flat position.

Next to being flexing and allowing that the structure lies and remains in a flat position when rolled out, assemblies comprising filaments in a parallel position may have the advantage of having a limited thickness as all filaments can be positioned next to each other.

The number of filaments in an assembly of grouped filaments ranges preferably between 2 and 100, for example between 2 and 81, between 2 and 20, for example 6, 7, 10 or 12.

Metal Filaments

As metal filaments any type of elongated metal filaments can be considered. Any metal can be used to provide the metal filaments. Preferably, the metal filaments comprise steel filaments. The steel may comprise for example high carbon steel alloys, low carbon steel alloys or stainless steel alloys. The metal filaments preferably have a tensile strength higher than 1000 MPa, for example higher than 1500 MPa or higher than 2000 MPa.

The metal filaments have a diameter preferably ranging between 0.04 and 8 mm. More preferably, the diameter of the filaments ranges between 0.3 and 5 mm as for example 0.33 or 0.37 mm.

All metal filaments of an assembly of grouped metal filaments may have the same diameter. Alternatively, an assembly of grouped filaments may comprise filaments having different diameters.

An assembly of grouped filaments may comprise one type of filaments. All filaments of an assembly of filaments for example have the same diameter and the same composition. Alternatively, an assembly of grouped filaments may comprise different types of filaments, for examples filaments having different diameters and/or different compositions. An assembly of grouped filaments may for example comprise non-metal filaments next to metal filaments. Examples of non-metal filaments comprise carbon or carbon based filaments of yarns, polymer filaments or polymer yarns, such as filaments or yarns made of polyamide, polyethylene, polypropylene or polyester. Also glass yarns or rovings of glass filaments can be considered.

The filaments preferably have a circular or substantially circular cross-section although filaments with other cross-sections, such as flattened filaments or filaments having a square or substantially square cross-section or having a rectangular or substantially rectangular cross-section can be considered as well.

The filaments can be uncoated or can be coated with a suitable coating, for example a coating giving corrosion protection.

Suitable coatings comprise a metal coating such as a zinc or zinc alloy coating or a polymer coating. Examples of metal or metal alloy coatings comprise zinc or zinc alloy coatings, for example zinc brass coatings, zinc aluminium coatings or zinc aluminium magnesium coatings. A further suitable zinc alloy coating is an alloy comprising 2 to 10% Al and 0.1 to 0.4% of a rare earth element such as La and/or Ce.

Examples of polymer coatings comprise polyethylene, polypropylene, polyester, polyvinyl chloride or epoxy.

For a person skilled in the art it is clear that a coating such as a coating giving corrosion protection can be applied on the filaments. However, it is also possible that a coating is applied on an assembly of grouped filaments.

Number of Assemblies

A group of assemblies of grouped filaments, such as the first group of assemblies of grouped filaments comprises at least two assemblies of grouped filaments. In principle there is no limitation to the number of assemblies of grouped filaments. The number of assemblies ranges for example between 2 and 500, for example between 4 and 300, for example 10, 20, 50, 100, 200, 300 or 400.

Preferably, the number of assemblies of grouped filaments of a group is defined per length unit of the width of the structure. The number of assemblies of a group of assemblies ranges for example between 2 and 500 per meter width. The number of assemblies is for example 10, 20, 50 or 100 per meter width.

Preferably, the different assemblies of a group of assemblies are spaced apart. The distance between neighbouring assemblies may vary within a wide range, the distance between neighbouring assemblies is for example higher than 1 mm and lower than 80 cm. The distance between neighbouring assemblies is for example ranging between 1 mm and 10 cm, for example 5 mm, 1 cm, 2 cm, 3 cm, 5 cm, 7 cm or 8 cm. Preferably, there is a minimum distance between neighbouring assemblies of grouped filaments.

The distance between neighbouring assemblies can be equal over the width of the structure for the reinforcement of pavements.

Alternatively, it can be preferred that the distance between neighbouring assemblies is lower in some areas of the structure, for example in areas where stresses are high.

A structure for the reinforcement of pavements according to the present invention may comprise one type of assemblies of grouped metal filaments. All assemblies of grouped metal filaments have for example the same number of metal filaments, the same construction and comprise the same material.

Alternatively, a structure for the reinforcement of pavements comprises a number of different types of assemblies of grouped metal filaments, for example assemblies of grouped metal filaments having a different number of filaments, having a different cord construction or made of a different material.

As mentioned above the assemblies of grouped metal filaments of the first group are positioned in a mutual parallel or mutual substantially parallel position in a first direction. Preferably, the first direction is different from the transverse direction of the structure.

In preferred embodiments, the angle (included angle) between said first direction and said longitudinal direction is ranging between −80 degrees and +80 degrees. More preferably the angle (included angle) between said first direction and said longitudinal direction is ranging between −60 degrees and +60 degrees, ranging between −45 and +45 degrees. For the purpose of this invention the smallest of the two angles defined by the longitudinal direction and the considered direction, for example the first direction is called the "included angle".

In other preferred embodiments the assemblies of grouped metal filaments of the first group are oriented in the longitudinal direction of the structure. In this case the angle (included angle) between said first direction and said longitudinal direction is zero or almost zero.

The structure for the reinforcement of pavements may comprise a second group of assemblies of grouped metal filaments. The assemblies of grouped filaments of the second group are preferably positioned in a mutual parallel or a mutual substantially parallel position in a second direction. The second direction is different from said first direction. Preferably, the second direction is also different from the transverse direction of the structure.

In preferred embodiments, the angle (included angle) between said second direction and said longitudinal direction is ranging between −80 degrees and +80 degrees. More preferably the angle (included angle) between said second direction and said longitudinal direction is ranging between −60 degrees and +60 degrees, ranging between −45 and +45 degrees.

Possibly, the structure for the reinforcement of pavements may comprise further groups of substantially parallel assemblies of grouped metal filaments, for example a third group of assemblies and possibly also a fourth group of assemblies. The assemblies of grouped filaments of the third group are oriented in a third direction; the assemblies of grouped filaments of the fourth group are oriented in a fourth direction. The third direction and the fourth direction are different from said first and second direction.

Thanks to the high flexibility of the structure for the reinforcement of pavements, the structure can easily be rolled up and rolled out. Furthermore when rolled out the structure lies in a flat position and remains in a flat position without requiring additional precautions or steps to obtain a flat position. This simplifies the installation of the structure.

According to a second aspect of the present invention methods to manufacture a structure for the reinforcement of pavements are provided. In a first method of manufacturing a structure for the reinforcement of pavements the assemblies of grouped metal filaments are coupled to a substrate comprising a non-metal material. In a second method of manufacturing a structure for the reinforcement of pavements the assemblies of grouped metal filaments are integrated in a substrate comprising a non-metal material. Both methods are described below in more detail.

The first method to manufacture a structure for the reinforcement of pavements according to the present invention comprises the steps of

- providing at least a first group of assemblies of grouped metal filaments,
- providing a substrate, said substrate comprising a non-metal material;
- coupling said assemblies of grouped metal filaments of said first group to said substrate so that said assemblies of grouped metal filaments are oriented in a first direction in a mutual parallel or mutual substantially parallel position.

The coupling of the assemblies of grouped metal filaments to the non-metal substrate can be obtained by any technique known in the art. Preferred techniques to obtain the coupling of the assemblies of grouped metal filament to the non-metal substrate is by stitching, knitting, embroidering, gluing, welding or melting.

In a preferred method the assemblies of grouped metal filaments are coupled to the substrate by at least one yarn. The yarn preferably forms stitches to couple the assemblies of grouped metal filaments to the substrate. The stitches are for example formed by stitching, knitting or embroidering.

If desired the assemblies of grouped metal filaments can be arranged in a structure such as a welded, woven, knitted or braided structure and this structure can be coupled to said substrate for example by stitching, knitting, embroidering, gluing, welding or melting.

The second method to manufacture a structure for the reinforcement of pavements according to the present invention comprises the steps of

- providing at least a first group of assemblies of grouped metal filaments,
- integrating said assemblies of grouped metal filaments in a substrate comprising non-metal material so that said assemblies of grouped metal filaments are oriented in a first direction in a mutual parallel or mutual substantially parallel position.

The assemblies of grouped metal filaments can for example be integrated in a polymer strip, for example during extrusion of the polymer material. In another method the assemblies of grouped metal filaments are integrated in a woven substrate, for example during the weaving of the woven substrate. The woven substrate comprises non-metal material next to the assemblies of grouped metal filaments. The assemblies of grouped metal filaments are for example in the warp direction of the woven substrate, whereas the weft direction comprises other elements such as non-metal elements.

In a further method, the assemblies of grouped metal filaments are integrated in a non-woven substrate, for example in a spunlaid or wetlaid substrate during the manufacturing of the non-woven substrate.

According to a third aspect of the present invention a reinforced pavement is provided. The reinforced pavement structure comprises

- a pavement, for example a pavement having a distressed and cracked pavement surface;
- a structure for the reinforcement of pavements according to the present invention;
- an overlay applied over said structure for the reinforcement of pavements.

The pavement comprises for example a concrete or asphalt pavement. The overlay comprises for example an asphalt overlay.

An advantage of using a structure according to the present invention is that thick overlays of for example 8 cm or more are not required as is the case for traditional steel meshes such as hexagonal woven meshes. For a structure for the reinforcement of pavements according to the present invention, the thickness of the overlay can be limited to less than 8 cm, for example less than 6 cm or less than 5 cm.

In a preferred embodiment the reinforced pavement further comprises an interlayer between said pavement and said structure for the reinforcement of pavements and/or between said structure for the reinforcement of pavements and said overlay. The interlayer comprises for example a binding layer or a tack layer.

According to a fourth aspect of the present invention, a method of installing a structure for the reinforcement of pavements is provided. The method comprises the step of

- positioning a structure for the reinforcement of pavements according to the present invention on a pavement surface, for example on a distressed and cracked pavement surface;
- applying an overlay over said structure for the reinforcement of pavements.

The overlay comprises for example an asphalt overlay.

By this method the structure for the reinforcement of pavements is interposed between the pavement surface, for example the old, cracked road surface and the newly applied overlay.

The method may further comprise the step of applying an interlayer such as a binding layer or a tack layer before and/or after the step of positioning the structure for the reinforcement of pavements.

It can be preferred that the pavement surface is pretreated before the structure for the reinforcement of pavements is positioned on the pavement surface. Possible pretreatments comprise texturizing or milling.

Thanks to the high flexibility of the structure for the reinforcement of pavements, the structure can easily be rolled up and unrolled. This is making the use on the construction site easy.

By installing a structure for the reinforcement of pavements according to the present invention, the reflective cracking from a distressed and cracked road surface to a newly applied overlay is avoided or at least retarded.

BRIEF DESCRIPTION OF THE DRAWINGS

The invention will now be described into more detail with reference to the accompanying drawings whereby.

DETAILED DESCRIPTION OF THE INVENTION

Figure 1:
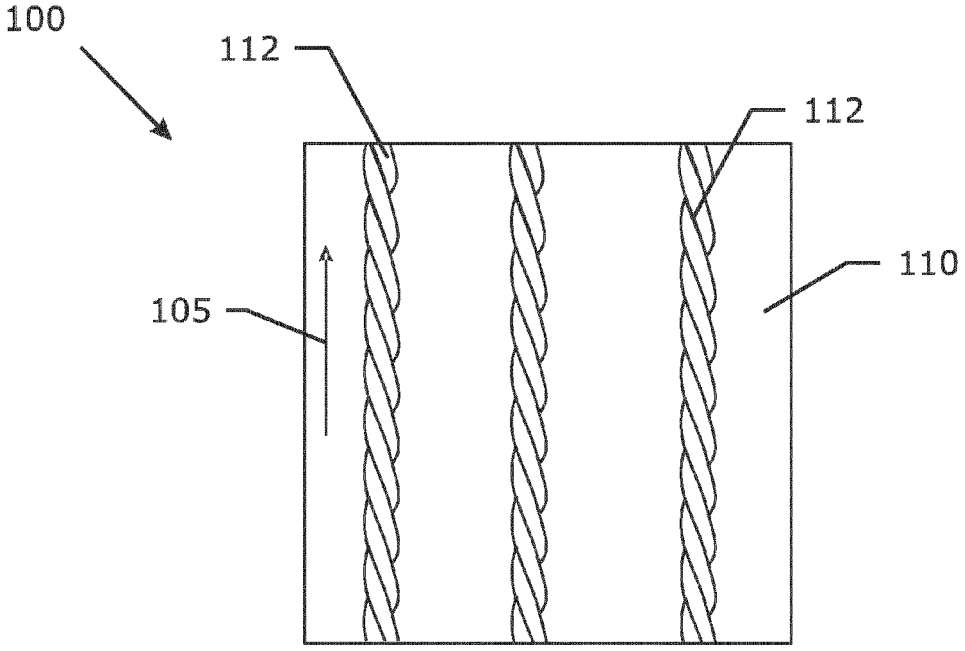
FIG. 1 is a schematic illustration of a structure for the reinforcement of pavements comprising assemblies of grouped metal filaments glued to a substrate.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

For the purpose of this invention "pavement" means any paved surface. The pavement is preferably intended to sustain traffic, such as vehicular or foot traffic.

Examples of pavements comprise roads, walkways, parking lots, airport runways, airport taxiways, . . . .

"Equivalent diameter of a yarn or filament" means the diameter of an imaginary yarn or filament having a circular radial cross-section, which cross-section has a surface identical to the surface area of the particular yarn or filament FIG. 1 is an illustration of a first embodiment of a structure 100 for the reinforcement of pavements according to the present invention. The structure 100 comprises a first group of assemblies of grouped metal filaments 112. The assemblies of grouped filaments 112 may comprise steel cords. A preferred steel cord comprises between 2 and 12 filaments, for example a cord having one core filament having a diameter of 0.37 mm and 6 filaments having a diameter of 0.33 mm around this core filament (0.37+6×0.33).

In alternative embodiments the assemblies of grouped filaments 112 comprise bundles of parallel or substantially parallel filaments, for examples bundles of 12 parallel or substantially parallel filaments.

The assemblies of grouped metal filaments 112 of the first group are all oriented parallel or substantially parallel to each other. The orientation of these assemblies of grouped metal filaments of the first group corresponds with the longitudinal direction 105 of structure 100. This is meaning that the included angle between the orientation of the assemblies of the first group (first direction) and the longitudinal direction is about 0 degrees. The assemblies of grouped metal filaments 112 are glued to a substrate 110.

The substrate 110 may for example comprise a polymer material, glass, carbon or any combination thereof. The substrate 110 is for example a grid or foil obtained by extrusion. Alternatively the substrate 110 comprises a woven or non-woven structure, for example a woven or non-woven polymer structure. Examples of non-woven structures comprise a needlepunched or spunbond non-woven substrate, for example in polyamide, polyether sulphone of polypropylene.

In a preferred embodiment the assemblies of grouped metal filaments comprise steel cords comprising twisted filaments. The steel cords are glued to a polymer substrate for example a non-woven polyether sulphone substrate or to an extruded polypropylene grid (35 g/m$^2$ having a 6×6 mm mesh).

In another preferred embodiment the assemblies of grouped metal filaments are steel cords that are glued to a substrate made of glass fibers or glass rovings or to a substrate comprising carbon filaments.

Figure 2:
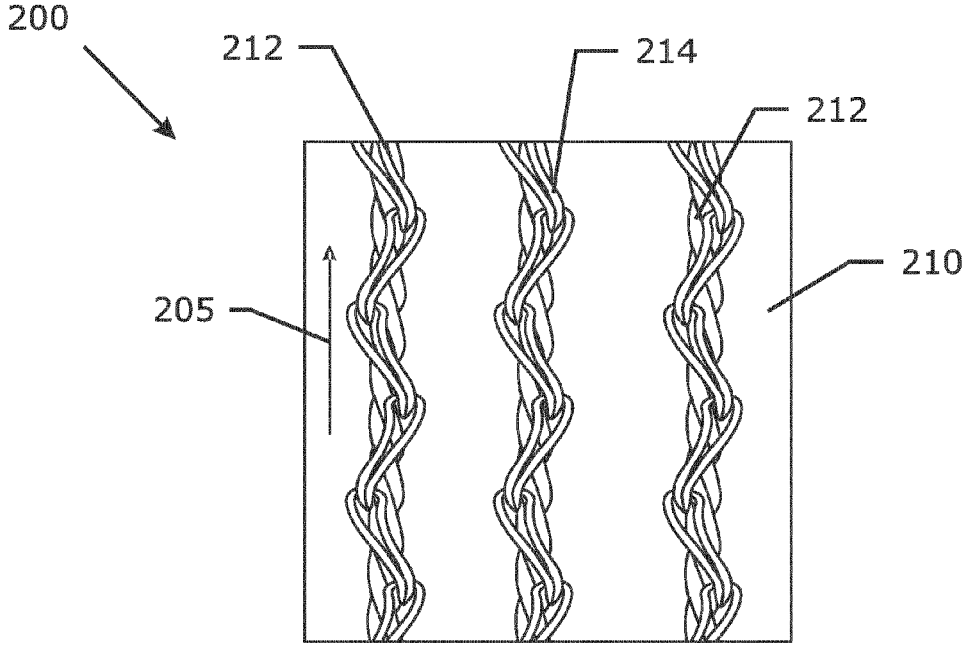
FIG. 2 is a schematic illustration of a structure for the reinforcement of pavements comprising assemblies of grouped metal filaments coupled to a substrate by stitches.

FIG. 2 is an illustration of a second embodiment of a structure 200 for the reinforcement of pavements according to the present invention. The structure 200 comprises a first group of assemblies of grouped metal filaments 212. The assemblies of grouped filaments 212 may comprise steel cords. The assemblies of grouped metal filaments comprise for example steel cords comprising 3 filaments having a diameter of 0.48 mm twisted together (3×0.48 mm).

In alternative embodiments the assemblies of grouped metal filaments 212 comprise parallel or substantially parallel filaments, for example a bundle of 12 parallel or substantially parallel filaments.

The assemblies of grouped metal filaments 212 of the first group are all oriented parallel or substantially parallel to each other. The orientation of these assemblies of grouped metal filaments of the first group corresponds with the longitudinal direction 205 of structure 200. This is meaning that the included angle between the orientation of the assemblies of the first group (first direction) and the longitudinal direction is about 0 degrees. The assemblies of grouped metal filaments 212 are coupled to a substrate 210 by means of stitches 212. The stitches are formed by a yarn.

The yarn comprises for example a multifilament yarn, preferably a polyamide, a polyether sulphone, a polyvinyl alcohol a polypropylene yarn. The substrate 210 comprises for example a woven or non-woven structure, for example a woven or non-woven polymer structure.

Examples of non-woven structures comprise a needlepunched or spunbond non-woven substrate, for example in polyamide, polyether sulphone of polypropylene.

In a preferred embodiment the assemblies of grouped metal filaments comprise steel cords comprising twisted steel filaments. The steel cords are stitched to a polymer substrate for example a non-woven polyether sulphone substrate by means of a polyether sulphone yarn.

Figure 3:
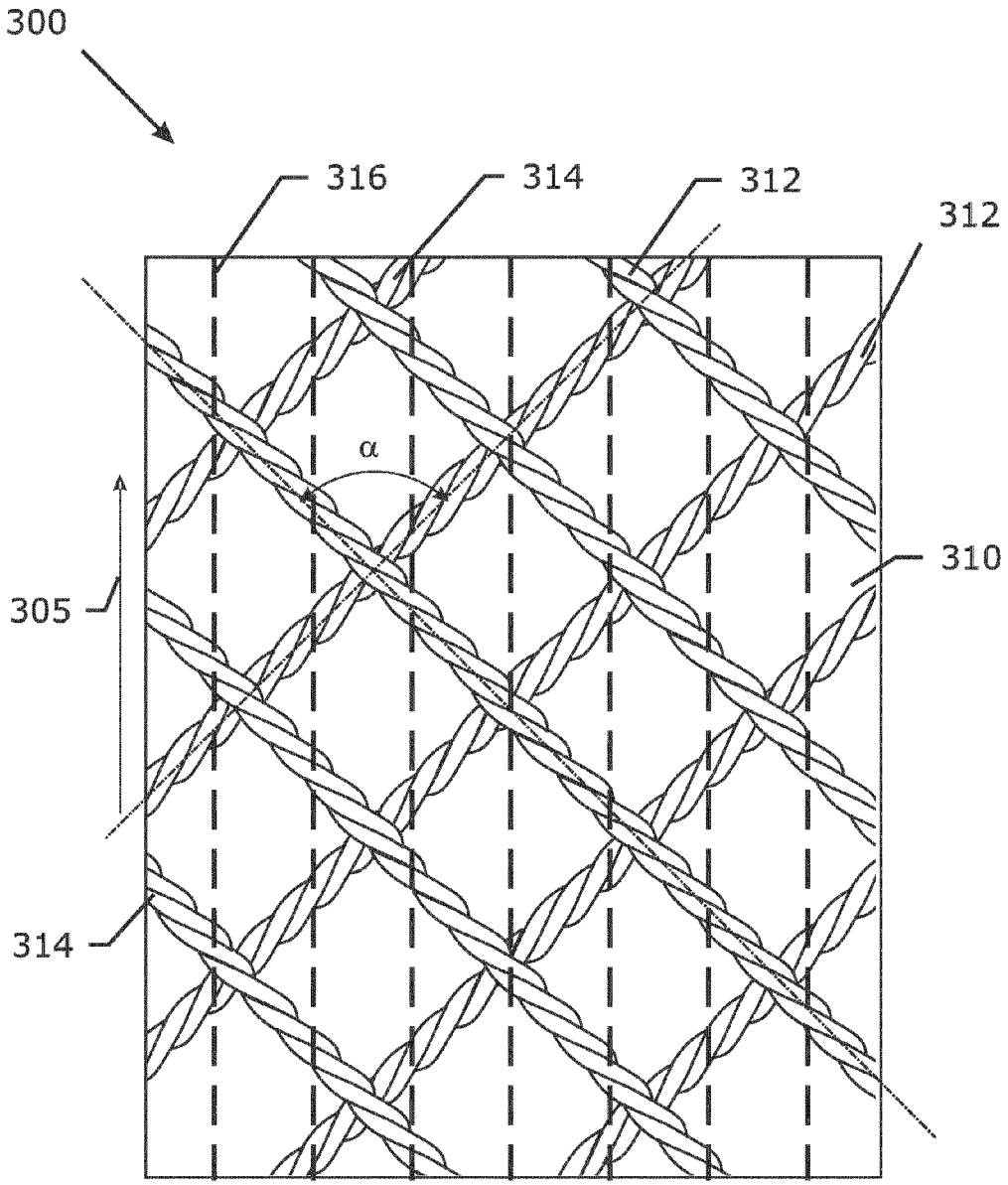
FIG. 3 is a schematic illustration of a structure for the reinforcement of pavements comprising a first group and a second group of assemblies of grouped metal filaments.

FIG. 3 is a further illustration of a structure 300 for the reinforcement of pavements. The structure 300 comprises a first group of assemblies of grouped filaments 312 and a second group of assemblies of grouped filaments 314. The first group of assemblies 312 comprises steel cords oriented substantially parallel to each other in a first direction. The second group of assemblies 314 comprises steel cords oriented substantially parallel to each other in a second direction. The first direction is different from the second direction. The included angle between the first direction and the longitudinal direction 305 of the structure 300 is 45 degrees. The included angle between the second direction and the longitudinal direction 305 of the structure 300 is 45 degrees. The included angle between the first direction and the second direction is indicated by $\alpha$. The included angle $\alpha$ is 90 degrees.

The assemblies of the first group 312 and the assemblies of the second group 314 are stitched to a substrate 310 along lines 316 by at least one yarn. The substrate 310 comprises for example a woven or non-woven structure.

Figure 4:
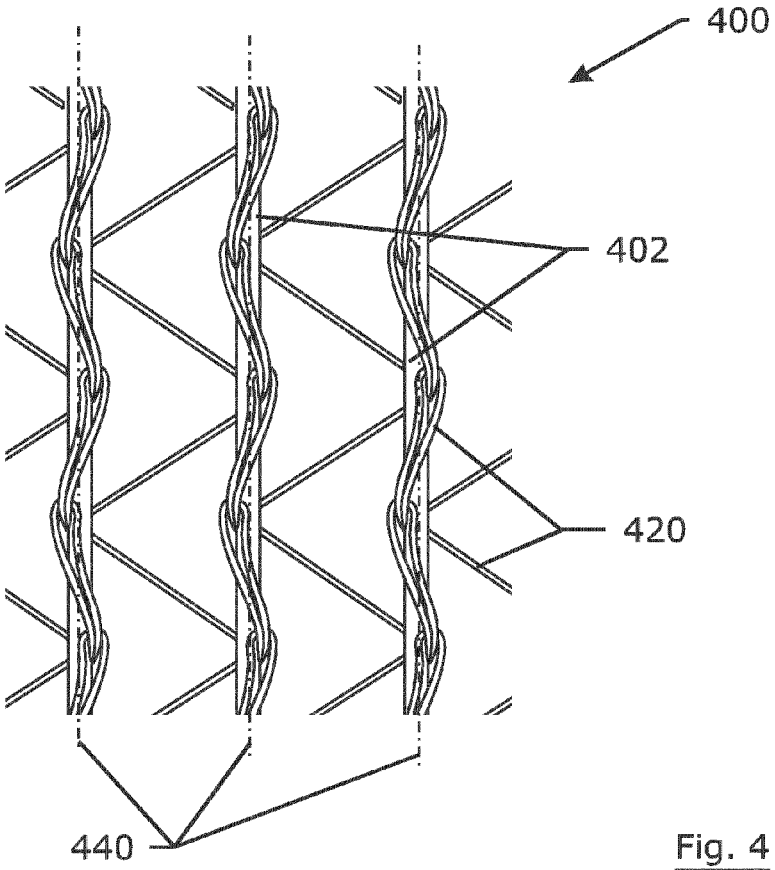
FIG. 4 is a schematic illustration of a structure for the reinforcement of pavements comprising a knitted structure.

FIG. 4 shows a schematic illustration of a structure 400 for the reinforcement of pavements. The structure 400 is a knitted structure. The knitted structure 400 comprises a number of assemblies of grouped metal filaments 402 in parallel or mutual substantially parallel position. In the knitted structure 400 shown in FIG. 4 the assemblies of grouped metal filaments are worked into the loop of stitches 420 at the stitch line 440. The stitches 420 are formed by a yarn, for example a single or multifilament yarn, preferably a polyamide, a polyether sulphone, a polyvinylalcohol, a polypropylene yarn or a metal yarn such as a steel yarn.

The textile stitches shown in this example are in a tricot configuration. Preferred assemblies of grouped metal filaments 402 comprise steel cords.

Figure 5:
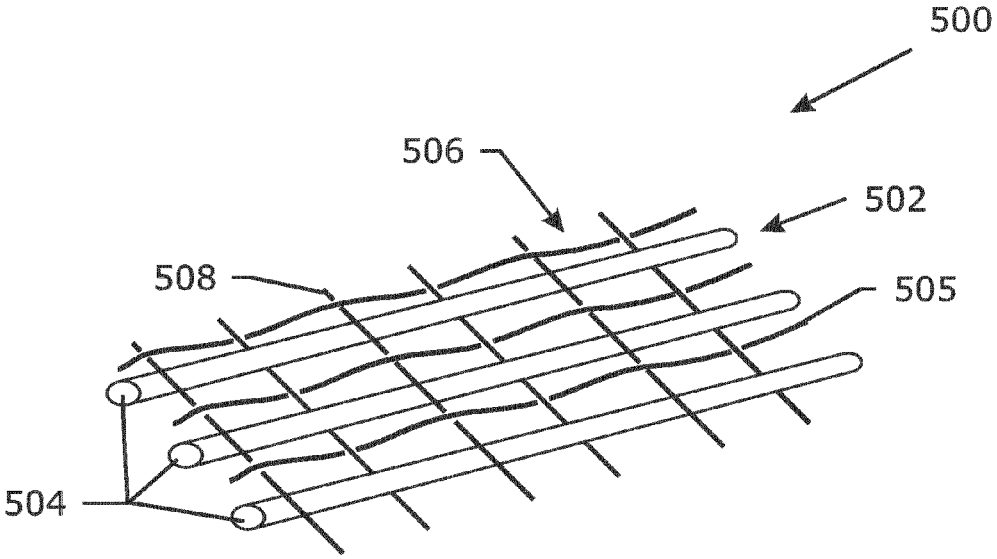
FIG. 5 is a schematic illustration of a structure for the reinforcement of pavements comprising a woven structure.

FIG. 5 is a schematic illustration of a structure 500 for the reinforcement of pavements. The structure 500 comprises a woven structure having in warp direction 502 a number of assemblies 504 of grouped metal filaments. The warp direction 502 may further comprise a yarn (a binding warp filament) 505, for example between two assemblies of grouped metal filaments 502.

The weft direction 506 comprises yarns, for example polyamide monofilaments (70 tex) 508. The structure 500 has a plain weave pattern.

The invention claimed is:

1. A pavement or a road comprising a structure for the reinforcement of pavements or roads, said structure having a longitudinal direction and a transverse direction, said structure comprising a first group of assemblies of grouped metal filaments, said assemblies of grouped metal filaments of said first group being oriented in a first direction in a mutual parallel or mutual substantially parallel position, said metal filaments having a tensile strength above 1000 MPa, having a filament diameter ranging between 0.30 mm and 5.0 mm and being zinc or zinc alloy coated, said assemblies of grouped metal filaments of said first group being coupled to or integrated in a substrate by at least one yarn, said yarn forming stitches, wherein said substrate consists of non-metal material.

2. The pavement or road according to claim 1, wherein said metal filaments comprise steel filaments.

3. The pavement or road according to claim 1, wherein said assemblies of grouped metal filaments comprise parallel filaments.

4. The pavement or road according to claim 1, wherein said assemblies of grouped metal filaments comprise filaments that are twisted together.

5. The pavement or road according to claim 1, wherein the included angle between said first direction and said longitudinal direction is ranging between −80° and +80°.

6. The pavement or road according to claim 1, wherein said first direction is oriented in the longitudinal direction of said structure.

7. The pavement or road according to claim 1, whereby said structure comprises a second group of assemblies of grouped metal filaments, said assemblies of grouped metal filaments of said second group being oriented in a second direction, said second direction being different from said first direction.

8. The pavement or road according to claim 1, said pavement further comprising an overlay on top of the structure.

9. The pavement or the road according to claim 1, wherein the at least one yarn is bendable to a radius of curvature smaller than five times a diameter of the at least one yarn.

10. The pavement or the road according to claim 1, wherein the stitches are formed around said group of assemblies of grouped metal filaments.

11. The pavement or the road according to claim 1, wherein filaments of the assemblies of grouped metal fibers having different diameters and/or are made of different materials.

12. The pavement or the road according to claim 1, wherein the assemblies of grouped metal filaments are worked into a loop of the stitches at a stitch line.

13. The pavement or the road according to claim 1, wherein the stitches are in a tricot configuration or a plain weave pattern.

14. The pavement according to claim 1, wherein the substrate is a non-woven foil.

15. The pavement according to claim 1, wherein the substrate is a grid.

16. A method to manufacture a pavement or road as defined in claim 1, said method comprising the steps of providing at least a first group of assemblies of grouped metal filaments, said metal filaments having a tensile strength above 1000 MPa, having a filament diameter ranging between 0.30 mm and 5.0 mm and being zinc or zinc alloy coated, providing a substrate consisting of non-metal material;

coupling or integrating said assemblies of grouped metal filaments of said first group to or in said substrate by means of at least one yarn forming stitches so that said assemblies of grouped metal filaments are oriented in a first direction in a mutual parallel or mutual substantially parallel position; and installing said coupled or integrated assemblies of grouped metal filaments of said first group to or in said substrate over a pavement or road surface, said pavement or road surface having a layer of asphalt.

17. The method according to claim 16, said method comprising the additional step of providing an overlay over said structure.

18. The pavement or the road according to claim 8, wherein the overlay has a thickness of less than 8 cm.

19. A pavement comprising a structure for reinforcement, and an asphalt pavement, wherein said structure has a longitudinal direction and a transverse direction, said structure comprises a first group of assemblies of grouped metal filaments, said metal filaments having a tensile strength above 1000 MPa, having a filament diameter ranging between 0.30 mm and 5.0 mm and being zinc or zinc alloy coated, said assemblies of grouped metal filaments of said first group being oriented in a first direction in a mutual parallel or mutual substantially parallel position, said assemblies of grouped metal filaments of said first group being coupled to or integrated in a substrate by means of at least one yarn forming stitches, wherein said substrate consists of non-metal material.

* * * * *